United States Patent [19]

Lemarchand

[11] Patent Number: 4,931,212

[45] Date of Patent: Jun. 5, 1990

[54] PROCESS FOR CONTINUOUS REGULATION OF THE POWER WITH WHICH PASTES INTENDED FOR THE FABRICATION OF CARBONACEOUS AGGLOMERATES ARE MIXED

[75] Inventor: Jean-Louis Lemarchand, St. Jean de Maurienne, France

[73] Assignee: Aluminium Pechiney, Paris, France

[21] Appl. No.: 640,114

[22] Filed: Aug. 13, 1984

[30] Foreign Application Priority Data

Mar. 19, 1984 [LU] Luxembourg ..... 85 258

[51] Int. Cl.[5] ..... H01B 1/02

[52] U.S. Cl. ..... 252/502; 252/511

[58] Field of Search ..... 252/502, 511; 366/142, 366/289, 601, 132; 204/17, 294, 264; 106/472, 476

[56] References Cited

U.S. PATENT DOCUMENTS 3,618,903 11/1971 Ronner et al. ..... 366/289

*Primary Examiner*—Josephine Barr

*Attorney, Agent, or Firm*—Dennison, Meserole, Pollack & Scheiner

[57] ABSTRACT

A process is disclosed for continuous regulation of the mixing of pastes which are intended for the fabrication of carbonaceous agglomerates, in a mixer provided with fixed teeth and movable teeth on a shaft, with mixing taking place by a rotary movement combined with a forward-back movement of the shaft, the mixer also having motorized flaps controlling the discharge of the carbonaceous paste.

Samples are taken during each rotation cycle of the shaft to measure the current consumed by the motor for certain particular positions of the shaft in its forward-back movement, and the intensity is compared to set point value which has been corrected as a function of the level of this current strength in relation to predetermined thresholds, and this corrected value is introduced into a regulator which determines the degree of opening of the discharge flaps for each cycle.

9 Claims, 1 Drawing Sheet

PROCESS FOR CONTINUOUS REGULATION OF THE POWER WITH WHICH PASTES INTENDED FOR THE FABRICATION OF CARBONACEOUS AGGLOMERATES ARE MIXED

BACKGROUND OF THE INVENTION

The present invention concerns a process for the continuous regulation of the power with which pastes which are intended for the fabrication of carbonaceous agglomerates are mixed.

Carbonaceous agglomerates are obtained by firing pieces of a carbonaceous paste placed in a mold. The paste is made by mixing an organic and a carbonaceous product in measured particles. The nature of the binder (coal pitch, petroleum pitch, liquid or solid pitch) and that of the carbonaceous particles (coal coke, petroleum coke, anthracite, etc . . . ) can vary a great deal. Depending on the intended use of the agglomerates, there is a stage of a prolonged mixing of the binder and the carbonaceous particles (of which the granulometric distribution is carefully controlled), at such a temperature that the binder is sufficiently fluid (60° to 180° C. for example) and for a length of time which assures as perfect as possible impregnation of the carbonaceous particles by the binder. The quality of the electrodes (evaluated particularly by the geometric density, the electric resistivity and the crushing resistance) produced after firing is quite dependent on the mixing efficiency.

In modern shops for the production of carbonaceous pastes-particularly for the manufacture of anodes for the production of aluminum by the Hall-Heroult process of alumina electrolysis in cryolite-the mixing of the mixture of binder plus carbonaceous particles is effected in a continuous mixing sequence which comprises one or sometimes two mixers in series.

One currently used type of mixer is shown in FIG. 1. It includes a tubular member 1 with fixed teeth 2 which are slanted in relation to the axis 3 of the tube within which a shaft 4 is moved in a back and forth movement synchronized with a rotary movement, and the shaft is provided with teeth 5 which cooperate with the fixed teeth to assure the mixing and flow of the carbonaceous paste. The fixed teeth are arranged in a helical line, and the amplitude of forward-back movement of the shaft is adjusted to the pitch of the arrangement of the fixed teeth. The discharge from the mixer(s) is through an aperture 6 which is blocked by motorized flaps 7. The opening and closing of these flaps can be controlled as a function of the thresholds of power at any given instant so as to assure satisfactory mixing of the paste and to avoid "clogging" of the apparatus, in other words its blocking with charge, as a result of a backup of excess filling.

This type of mixer has been described particularly in Swiss patents A-515 061, CH 606 498 and French Patent A-2 038 173, in the name of BUSS A. G.

The rate of opening of the discharge flaps can be manually controlled but most often regulation based on the value of the mean power consumed by the motor over a short period of time (regulation of the PID type-Proportional Integral Derivative) is used.

By observation of the current consumption curve as a function of time (directly proportional to the power in this case, with the mixer being powered with direct current), it is clear that it presents the shape of a pseudo-sinusoid of which the amplitude varies as a function of the different parameters (position of the flaps, rate of mixer filling, characteristics of the paste, etc . . . ).

The time period for this pseudo-sinusoid is equal to the time of the back and forth movement of the axis of the mixer, which is on the order of one second or slightly more.

Because of this double mechanical movement, and in the case of the use of PID-type regulation, a filter of constant RC time must be introduced in order to survey the oscillations over a short period due to the cycle of the mixer (advance and return of the main shaft).

The position of the flaps is then under control of a mean value of current which is dependent upon the time constant of the RC circuit. Preferably, the time constant T=RC is selected to be at least equal to the period of the forward-back movement of the mixer shaft. However, this simple regulation presents the drawback in some cases of not being sufficiently rapid to avoid the effects of clogging up the apparatus, particularly when one tries to use a high mixing power, near the maximum which the motor can furnish. Moreover, the user, as a security measure, uses the mixer below its maximum capacity so that a sufficient motor reserve power is available in case of clogging, to overcome the clogging and return the mixer to operation.

For a certain number of fabrications which require great regularity and the precise characteristics of the carbonaceous agglomerates, for example, anodes for electrolytic aluminum production, the process of regulation of the mixing does not always allow for the optimum quality and uniformity of the anodes which is claimed by promotors of the process, and underuse of the available capacity is quite a problem.

Additionally, in order to obtain the best quality anodes, it is necessary to optimize and/or maximize the mixing power in kilowatt-hours per ton of paste, and to apply this power very homogeneously to all of the paste being discharged from the mixer of the mixing sequence.

A very fine regulation of the mixing is thus required, meaning regulation of the rate of opening the discharge flaps of the mixer as a function of the power used at a given instant by the motor. The analog regulation only very imperfectly regulates this, since it integrates the variations of intensity of one or more cycles of rotation of the mixer shaft.

SUMMARY OF THE INVENTION

The invention is based on analysis of the operation of the mixer and on observation of the variations of current consumed by the motor in the course of successive cycles of forward and back movement of the rotating shaft. Instead of measuring the intensity continuously, as in analog regulation, the current is measured by sampling four instantaneous values during each cycle.

DETAILED DESCRIPTION OF THE INVENTION

Figure 1:
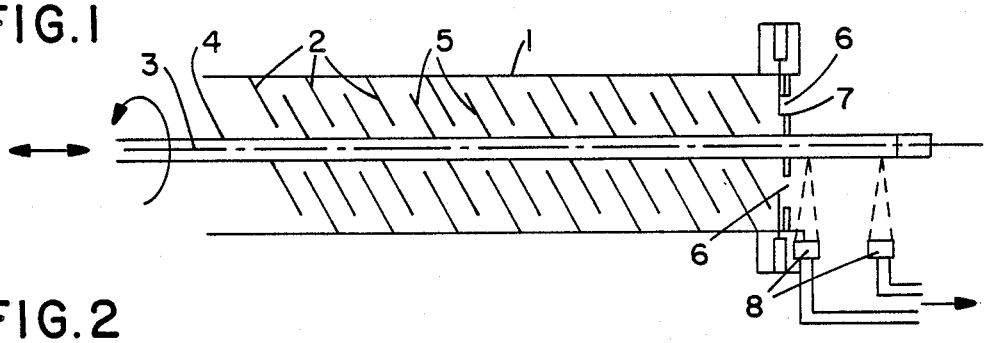
FIG. 1 is a very simplified horizontal cross section of the type of mixer to which the invention is particularly applied.
Figure 2:
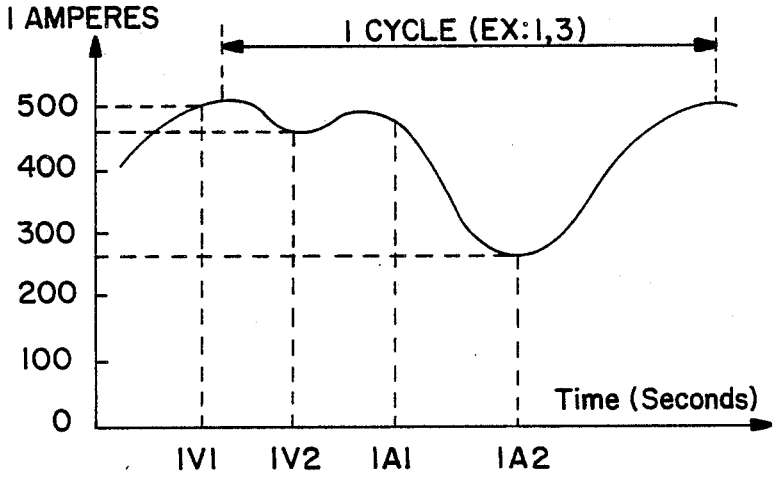
FIG. 2 is a graph of current consumed by the motor vs. time for one cycle.

The principle of the regulation of the present invention as a result of sampling is the following: the current consumed by the motor is measured for two certain positions of the axis of the mixer in its forward-back movement, these positions being detected by means of two fixed pick-ups 8 in FIG. 1. Two measures of intensity IV1 and IV2 are measured when the shaft is in "forward" position, and two measures IA1 and IA2 when the shaft is in "back" position. The curve of variation of the intensity as a function of the time, for each cycle, appears in FIG. 2.

The first measure IV1 is taken at the moment when each movable tooth of the shaft has practically arrived in forward contact, through the layer of carbonaceous paste, with the corresponding fixed teeth, and then the paste is being extruded from the mixer.

The second measure IV2 is taken when the absorbed intensity passes through a first power minimum corresponding essentially to the beginning of the return movement of the shaft; because of the rotating of the shaft, the movable teeth are now found in the spaces between the fixed teeth. Therefore the paste is no longer being compressed between fixed and movable teeth, but is simply being mixed, and slightly decreased force is required from the motor.

The third measure IA1 is taken during the rearward movement when the movable teeth on the shaft begin to compress the carbonaceous paste against the corresponding fixed teeth situated at the back.

Finally, the fourth measure IA2 is taken when the power absorbed by the motor passes through a second minimum corresponding to the moment when, the shaft having again reversed its movement, the movable teeth again pass between the fixed teeth.

The two important values for the regulation are IA2 and IV2, i.e. the two minima. Therefore it is important to set the positions of the fixed pick-ups 8 to make the measures IA2 and IV2 coincide with the minima of intensity.

The principle regulation parameter is IV2, which can be associated with the extrusion pressure when the paste is being extruded from the mixer. This value is introduced to the regulation algorithm regulating the degree of opening of the flaps, and particularly in the following manner, as a nonlimiting example of the use of the invention:

The rate of opening of the flaps in per-thousandths in the course of the n cycle is shown by:

$$(1000/P)\left[(C - I_n) + \sum_{o}^{n} (I/1000) \times (C - I_n)\right] + 500 \quad (1)$$

wherein:

P and I are the parameters of the PID regulation (Proportional Integral Derivative), and D=0

$I_n$ is the last value of IV2 intensity measured in the course of the n cycle

C is the ordered intensity 500 is an adjustable constant n is the rank of the cycle being considered.

However, for the high levels of power absorbed by the motor, the variations of IV2 are of lower amplitude than those of IA2 (FIG. 3), which can be considered as representative of the filling level of the mixer. There are two results of this:

(a) as explained in the analysis of the operation of the mixer, experience shows that the rapid increase of IA2 is the index of a tendency toward "clogging" of the mixer. That signifies, in fact, that at the beginning of the forward movement of the shaft, the movable teeth are meeting very little volume resistance, and the carbonaceous paste will very shortly be virtually filling the mixer. If there is not rapid intervention in this situation, the shaft becomes blocked, the security system disconnects the electric feed to the motor, and a part of the carbonaceous paste heated to approximately 160° C. must be manually removed before restarting the motor. This long and laborious operation leads users to underfeed mixers or to use oversized mixers, or to provide mixers with greatly oversized motors, to avoid clogging or to minimize its consequences, all of which greatly increases the costs of the process.

The implementation of the regulation system according to the invention allows detection of the approach of clogging when IA2 exceeds predetermined absolute threshold SB, and allows immediate reaction, either by opening the discharge flaps or by accelerating the rotation speed of the mixer, or by both steps taken simultaneously.

(b) to take into consideration, in the regulation system, the rate of filling which is deduced from the value IA2, the value of this parameter IA2 is compared, for each cycle, to that of a floating threshold P2, determined from the set point of intensity C. As long as IA2<P2, the parameter of regulation $I_n$ is calculated following incrementation of a predetermined quantity of IV2, as indicated above.

If IA2 becomes >P2, the parameter of regulator $I_n$ is calculated following incrementation of IV2 of a predetermined quantity, for example:

$$I_n = IV2 + (IA2 - P2) \quad (2)$$

Figure 3:
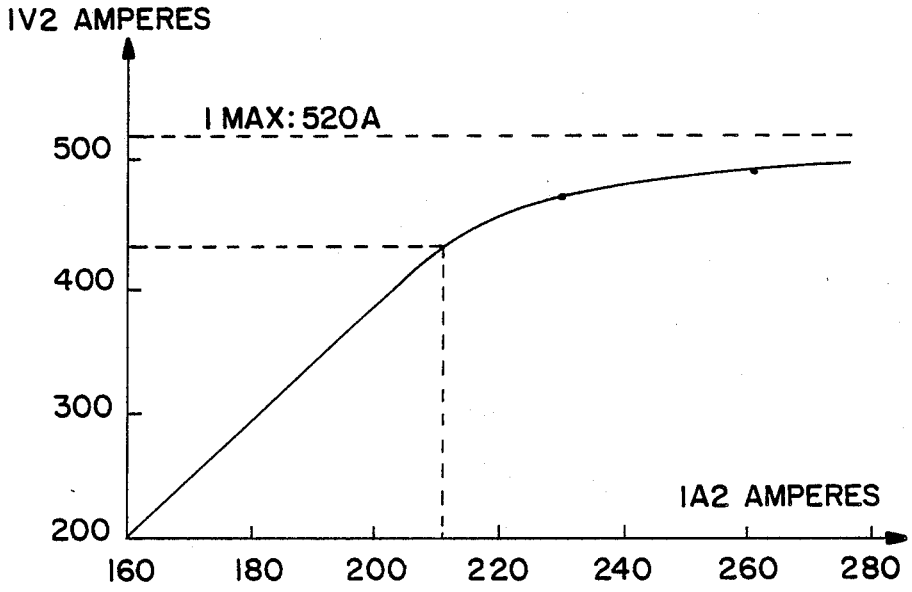
FIG. 3 is a graph of current at time IV2 vs. current at time IA2.

In the case of FIG. 3, for example, if one has:

IV=465 amperes

IA2=240 amperes

P2=210 amperes then: $I = 465 + (240 - 210) = 495$ amperes.

Then this value of 495 A (instead of 465 A) will be introduced into the regulation, and the more rapid response will then cause opening of the flaps wider than would have been the case of a IV2 of 465 A, and the effect will be to hinder closing. Therefore, the mixer can be used continuously and without risk near its maximum power.

In addition to this floating threshold P2, two fixed thresholds S1 and S2 are also used, which are of higher value than P2, to which IA2 is also continuously compared.

When IA2 exceeds the first fixed threshold S1 (or second S2), the difference between IA2 and S1 (or S2) is added x times, for example three times (or y times, for example four times) to the value of $I_n$ which is calculated as aforementioned (equation 2). Then the regulation parameter $I_n$ becomes (in amps):

$$\text{If } IA2 < P2, \text{ then } I_n = IV2_{(n)} \quad (3)$$

$$\text{If } P2 < IA2 < S1, \text{ then } I_n = IV2_{(n)} + (IA2 - P2) \quad (4)$$

$$S1 < IA2 < S2, \text{ then } I_n + IV2_{(n)} + (S1 - P2) + 3(IA2 - S1) \quad (5)$$

If S2<IA2<SB, then $$I_n = IV2_{(n)} + (S1 - P2) + 3(S2 - S1) + 4(IA2 - S2) \quad (6)$$

If IA2>SB, $I_n$ does not intervene. An "emergency reaction" occurs to counter the clogging by opening the discharge flaps and/or increasing the speed of the mixer.

The respective levels (expressed in amps) of parameter C and of thresholds P1, S1, S2 and SB are set by the user as a function of the type of mixer used and of the work conditions, for example, composition and temperature of the carbonaceous paste. It is the same case for the factors of multiplication x and y (3 and 4, in the example) of the values of the correction increments (IA2−S1), (S2−S1), (IA2−S2) which are given as nonlimiting examples.

This regulation device, implemented by a programmable means for automation, allows regulation of the position of the discharge flaps of the mixer or any other equivalent device controlling the flow of the carbonaceous paste upon discharge from the mixer so as to optimize or maximize the power in kilowatt-hours consumed per ton of paste produced, without risk of clogging and by using the mixer near its maximum capacity.

IMPLEMENTATION OF THE INVENTION

In practice, the invention is implemented under the following conditions:

1. The value of the mixing force to be applied to the carbonaceous paste is set, in kilowatt-hours per ton;
2. The timed flow through the mixer, which will be essentially the nominal set flow through the entire assembly, is set to correspond to the total coke+binder weight introduced at the head of the mixing sequence;
3. The maximum set point intensity C of the current feeding the motor of the mixer is set;
4. The mixer is started up and fed with coke+binder;
5. The instantaneous values of IV1, IV2, IA1, IA2 are measured in each cycle, by sampling, as indicated above;
6. In each n cycle:
   (a) the value of $IA2_{(n)}$ is compared with the value of P2 calculated by the system as a function of the set point parameter C as well as a function of the different set, predetermined thresholds S1, S2 and SB,
   (b) If $IA2_{(n)}$<P2, the variable of regulation $I_n$ remains equal to $IV2_{(n)}$,
   (c) If $IA_{(n)}$>P2, the regulation variable $I^n$ is calculated automatically by adding a quantity determined from the value of $IA2_{(n)}$ in relation to the different threshold P2, S1, S2, as indicated above (equations 3 to 6) to $IV2_{(n)}$.

The value of the regulation variable $I_n$ is introduced into the regulation algorithm from which the regulator determines the optimum flap opening and also controls the different security systems. In particular, when the mixing sequence includes two mixers in series, the regulator also controls the second mixer and assures the compatibility between the flow of the first and the flow of the second at any particular instant, and the flow of the second must be at least equal to that of the first or the second will clog very rapidly.

Regulation according to the invention can generally be applied either to the first mixer or to the second, or to both simultaneously, by assuring the compatability between the flows of each of them at any instant so as to avoid the risk of clogging.

In the following practical examples, a series of tests has been carried out on a mixing sequence composed of two mixers of the first type (K 600 and K 550 KE) manufactured by Ets. BUSS A. G., having a flow of nearly thirty tons per hour and arranged in series.

The paste, intended for fabrication of preferred anodes for the production of aluminum, comprises petroleum coke, of apparent mercury density of 1.72 g/cc, and 14.5% coal pitch with a Mettler softening point of 110°. The paste was mixed at approximately 160° C.

EXAMPLE 1

For comparison, a first series of 100 anodes for electrolysis of aluminum was produced in conditions customary in the prior art in such a manner as to obtain a mixing force of approximately 3.8 kWh/t of paste (which is a power of 105 kW consumed by the motor).

EXAMPLE 2

A second and a third series of tests, also applied to 100 anodes, were performed according to the invention by regulating the opening of the flaps of the first mixer in accordance with the power consumed by its motor, in such a manner that the mixing force is of 4.9 kWh/t of paste in the second test, and 7.3 kWh/t of paste in the third test. The power consumed by the motor was 135 kW in the second test and 200 kW in the third test, i.e. practically the maximum power for which it was tested.

For the three series of tests, the flaps of the second mixer were held in the same position, corresponding to a mixing force of 2.5 kWh/t of paste (which is 74 kW consumed by the motor).

The mixed paste was vibro-rammed into a mold, and the anodes were fixed at approximately 1100° C. in the customary conditions, in a rotating burner furnace.

Samples were taken, the characteristics of the anodes produced in the three series of tests were measured, and the following results were obtained:

| | | Invention | |
|---|---|---|---|
| | Prior Art Test #1 | Test #2 4.9 + 2.7 kWh/t | Test #3 7.3 + 2.7 kWh/t |
| Density in g/cc | 1.55 ± 0.02 | 1.592 ± 0.011 | 1.594 ± 0.014 |
| Electrical resistivity μΩ cm | 5600 ± 170 | 5120 ± 122 | 5060 ± 54 |
| Resistance to crushing in MPa | 425 ± 30 | 500 ± 32 | 504 ± 43 |

This example shows that the implementation of the invention produces an important gain in the mean values as well as in the scattering of these values, and the results can be attributed to better homogeneity of the paste due to the stabilization in time of the mixing force.

By use of the present invention to produce anodes, a great improvement can be obtained in the results of the electrolysis:

1. Up to 40 kWh/t of aluminum, as result of the lowering of the resistivity of the anodes,
2. up to 5 kg of carbon/ton of A1,
3. approximately 1 day extension of the useful life of anodes, correlating with lower costs of production.

What is claimed is:

1. In a process for the production of pastes which are intended for the fabrication of carbonaceous agglomerates in a continuous mixing sequence, said pastes comprising a mixture of carbonaceous particles and an organic binder which is introduced in solid or liquid state, wherein the mixer comprises a tubular body provided on its inside surface with a plurality of fixed teeth which are slanted in relation to the axis of the tubular body, and mounted within said tubular body, a rotating shaft coaxial with the tubular body actuated with a back and forth movement synchronized with a rotary movement produced by a direct current motor, this shaft being provided with teeth cooperating with the fixed teeth to provide mixing and flow to the carbonaceous paste, wherein the mixer is provided with an aperture for discharge of said pastes, the degree of opening of the aperture being set by motorized flaps, the continuous regulation of the power for mixing comprising the steps of:

a. setting the value of the mixing force which is to be applied to the carbonaceous paste in kilowatt-hours per ton, and setting the timed flow of the mixer and the set point intensity C of the current feed to the motor;

b. starting up the mixer;

c. measuring the current consumed by the motor, which is proportional to the power, the motor being supplied direct current at an essentially constant voltage;

d. taking four readings of current IV1, IV2, IA1, and IA2, in each cycle of back and forth movement of the shaft, wherein readings IV1 and IV2 are taken when the shaft is in the forward position and IA1 and IA2 are taken when the shaft is in the back position, IV1 being measured at the moment when the movable teeth of the shaft arrive practically in contact, through a layer of carbonaceous paste, with the fixed teeth, and when the paste is being extruded from the mixer, IV2 being measured when the intensity passes through a first minimum corresponding essentially to the beginning of the return movement of the shaft, IA1 being measured during return movement, when the movable teeth of the shaft begin to compress the carbonaceous paste against the corresponding fixed teeth at the rear, IA2 being measured when the intensity passes through a second minimum corresponding to the moment when, the shaft having reversed its movement, the movable teeth pass between the fixed teeth; and e. introducing the $I_n$ value of current at IV2 measured in the course of the n cycle into the algorithm of regulation, from which the regulator determines the rate of opening of the flaps.

2. The process of claim 1, wherein the rate of flap opening, in per-thousandths, is determined by the following equation:

$$(1000/P)\left[(C - I_n) + \sum_{o}^{n} (I/1000)(C - I_n)\right] + 500$$

wherein:

P and I are the Proportional Integral regulation parameters,

C is the set point value of the intensity, $I_n$ is the value of intensity IV2 in the course of cycle n, n is the rank of the cycle being tested, and 500 is an adjustable constant of the regulation system.

3. The process of claim 2, wherein for each cycle n, the value of IA2 is compared to a certain number of thresholds of increasing intensity of value, and wherein a value $I_n$ of IV2 incremented by a value determined from the position of IA2 in relation to these different thresholds is introduced into the regulator.

4. The process of claim 3, wherein 4 successive thresholds of increasing intensity, P2, S1, S2 and SB, are set, to which IA2 is compared during each n cycle, according to the following:

If IA2 is smaller than P2, then $I_n = IV2_{(n)}$,

If P2<IA2<S2, then $I_n = IV2_{(n)} + (IA2 - P2)$,

If S1<IA2<S2, then $I_n = IV_{(n)} + (S1 - P2) + 3(IA1 - S1)$,

If S2<IA2<SB, then $I_n = IV2_{(n)} + (S1 - P2) + 3(S2 - S1) + 4(IA2 - S2)$.

5. The process of claim 4, wherein $IA2_{(n)} > SB$, and an emergency reaction takes place to counter clogging of the mixer by opening the flaps and/or by increasing the rotation speed.

6. The process of claim 1, wherein the mixing sequence includes two mixers in series, the regulation is effected on the first mixer and the flow of the second is at least equal to the flow of the first at any instant.

7. The process of claim 6, wherein the rotation speed of the second mixer is controlled to absorb the excess flow arising from the first mixer at any instant, when the flaps are opened or the speed has been increased to avoid clogging.

8. The process of claim 1, wherein the mixing sequence includes two mixers in series, the regulation is effected on the second mixer and the flow of the first is controlled so that it is slower than or equal to that of the second.

9. The process of claim 1, wherein the mixing sequence includes two mixers in series, the regulation is effected on the two mixers and the flow of the second is controlled in such a manner that it is at least equal to that of the first.

* * * * *